US005460286A

United States Patent [19]

Rush et al.

[11] Patent Number: 5,460,286

[45] Date of Patent: Oct. 24, 1995

[54] BEVERAGE CUP LID HAVING AN ANNULAR FLANGE EXTENSION FOR INCREASED CAP RETENTION FORCE, AND METHOD OF MANUFACTURE

[75] Inventors: Jonathan E. Rush, Phillipsburg, N.J.; Thomas R. Toczek, Nazareth, Pa.

[73] Assignee: James River Corporation of Virginia, Richmond, Va.

[21] Appl. No.: 101,733

[22] Filed: Aug. 4, 1993

[51] Int. Cl.[6] ..... B65D 41/46

[52] U.S. Cl. ..... 220/306; 220/709; 220/711

[58] Field of Search ..... 220/254, 269, 220/306, 709, 711, 712, 713

[56] References Cited

U.S. PATENT DOCUMENTS

| | | | |
|---|---|---|---|
| 3,447,714 | 6/1969 | Elliot . | |
| 4,079,857 | 3/1987 | Crisci . | |
| 4,090,660 | 5/1978 | Schram et al. . | |
| 4,322,015 | 3/1982 | Bailey | 220/269 X |
| 4,705,172 | 11/1987 | Gage . | |
| 4,877,151 | 10/1989 | Rush et al. . | |
| 5,147,065 | 9/1992 | Rush et al. . | |
| 5,183,172 | 2/1993 | Boller . | |

*Primary Examiner*—Gary E. Elkins
*Attorney, Agent, or Firm*—Sixbey, Friedman, Leedom & Ferguson

[57] ABSTRACT

A beverage cup lid is disclosed that comprises a circular closure panel, circumscribed by a side wall that terminates in a resilient, restricted diameter edge for capturing a brim of a beverage cup, and a frustro-conical skirt connected around the restricted diameter edge for increasing the hoop strength of the edge, and an extended diameter flange circumscribing the free edge of the skirt for further increasing the hoop strength of the restricted diameter edge such that the edge retains the brim with a force of at least 1 pound. The invention is particularly applicable to beverage cup lids formed by a plastic web machine that applies heat to only those areas that are deformed into structural components on the lid (such as the side wall, restricted diameter edge, and skirt), and which consequently results in some amount of wall thinning in the skirt, and hence some reduction in the hoop strength that the skirt gives to the restricted diameter edge that retains the cup brim. The radial extent of the flange is large enough to increase the hoop strength, and hence retaining force of the restricted diameter edge by between 0.5 and 1.0 pounds.

6 Claims, 2 Drawing Sheets

BEVERAGE CUP LID HAVING AN ANNULAR FLANGE EXTENSION FOR INCREASED CAP RETENTION FORCE, AND METHOD OF MANUFACTURE

BACKGROUND OF THE INVENTION

This invention generally relates to lids for beverage cups, and is specifically concerned with a disposable beverage lid having a reduced diameter edge that snap-fits over the brim of a drinking cup, wherein the retention force of the edge around the cup brim is increased by the provision of an extended diameter flange that increases the hoop strength of the reduced diameter edge.

Disposable beverage cup lids are well known in the prior art. Such cup lids are formed from a fusible plastic sheet material, and are designed to snap-fit over the top of a disposable beverage cup to keep the liquid contents of such cups from spilling during transport. In the past, such lids were thermoformed into plastic sheet material by applying radiant heat uniformly throughout a single piece of sheet material to soften the sheet material at all points, and then pneumatically pressing the softened sheet of material against a plurality of lid molds by the creation of a partial vacuum between the sheet material and the molds. After the molding operating was completed, the vacuum pressure between the sheet material and the molds was normalized so that the sheet could be easily pulled from the molds, and the resulting lid blanks were then individually cut out of the sheet by means of a trim press having a mechanical action similar to that of a common hole punching machine for paper.

An example of a snap-on lid manufactured by this process is disclosed in U.S. Pat. No. 4,877,151 assigned to James River Corporation. Such lids generally comprise a circular closure panel circumscribed by a side wall that terminates in a reduced diameter edge. The reduced diameter edge is dimensioned so that it is capable of snap-fitting over the annular brim that circumscribes the open end of a disposable drinking cup. To provide the reduced diameter edge with sufficient resiliency to achieve its purpose, a plurality Of flutes are provided in the side wall that circumscribes the central, circular panel of the lid. A frustro-conically shaped skirt is integrally connected to the reduced diameter edge. This skirt flares outwardly and downwardly from the edge, and not only increases the hoop strength of the reduced diameter edge, but also advantageously receives, guides, and wedgingly snaps the reduced edge of the lid over the annular brim of the drinking cup when it is pressed downwardly over the open end of the cup. The free edge of the frustro-conical skirt is typically circumscribed by a very short flange having a radial length of only about 0.030 inches. Ideally, it was thought that the flange that circumscribes the outer edge of the frustro-conical skirt should be eliminated altogether, as it served no significant purpose in the lid. However, in view of the tolerances associated with the operation of the trim press, it was necessary to leave some small amount of flange to insure that no parts of the skirt were inadvertently cut during the trimming operation.

While the snap-on lid disclosed and claimed in U.S. Pat. No. 4,877,151 represented a substantial advance in the art, the inventors observed that when lids of this design were manufactured in certain types of thermoforming machinery, the retention force between the lid and the cup fell to lower than optimal levels (i.e., in some cases, under 1 pound of force). In particular, the applicants observed that when such cups were made by way of plastic web machine, which applied localized, contact-type heating to only those portions of the sheet material which were going to be deformed by the mold, the resultant stretching in the side wall area weakened the hoop strength of the restricted diameter edge that snap-fits over the brim of the beverage cup, which in turn resulted in a lower than optimal retention force between the lid and the cup.

While the applicants recognized that it would be possible to increase the hoop strength of the restricted diameter edge by either decreasing the diameter of the edge, or modifying the pattern of flutes in the side wall which determines the resiliency of the restricted edge, or even lengthening the frustro-conical skirt that is integrally connected to the edge, any of these approaches would necessitate an expensive re-machining operation on each of the lid molds. Additionally, if the restricted diameter were made smaller, or the skirt were made longer, it might be difficult, if not impossible, to remove the lid blanks from the mold. Still another solution that the applicants contemplated was to make the sheet material which forms the lids thicker. While in actual tests this approach succeeded in increasing the hoop strength of the restricted diameter without the need for making expensive changes in the lid molds, it necessitated the use of larger amounts of plastic material to produce the lid, which in turn resulted in a substantial increase in manufacturing cost.

Clearly, what is needed is a way to increase the hoop strength of the restricted diameter to at least a 1.5 pounds without the need for an expensive re-machining of the molds, and without the use of thicker sheet material.

SUMMARY OF THE INVENTION

Generally speaking, the invention is an improved beverage cup lid of the type manufactured by a partial thermal-forming process which compensates for the reduced hoop strength given to the restricted diameter edge by the frustro-conical skirt by the provision of a flange extension that circumscribes the free edge of the skirt. The radial extent of the flange extension is chosen so as to increase the hoop strength of the frustro-conical skirt such that the restricted diameter edge that captures the brim of the beverage cup secures the brim with a force of at least 1.25 pounds. This also provides a more conveniently grippable surface than the previously-used short flange that facilitates the removal of the lid by the finger of a user.

In the preferred embodiment, the radial extent of the flange is between about 0.020 to 0.040 inches, and the radial extent of the flange extension is between about 0.032 and 0.052 inches such that the flange extension increases the retention force of the lid around the brim by between 0.25 and 0.50 pounds.

In the method of the invention, a lid is formed from a sheet of heat fusible, plastic sheet material by first selectively applying heat to only those portions of the sheet material that will be deformed into the side wall, the reduced diameter edge, and the frustro-conical skirt of the lid, deforming said selectively heated portions into said side wall, restricted diameter edge, and frustro-conical skirt, and then creating both the flange and the flange extension by making a circular cut in the sheet material around the outer edge of the skirt. The cut is spaced apart from the outer edge of the skirt such that the aforementioned flange and flange extension is formed that increases the hoop strength of the restricted diameter edge such that it retains the brim that circumscribes the cup with a force of at least 1.25 pounds.

In the preferred method of the invention, the side wall, restricted diameter edge, and skirt of the lid is formed by means of a plastic web machine of the type that applies heat to only the portions of the fusible plastic sheet material that are deformed with respect to the circular closure panel that constitutes most of the lid, and the trimming step is implemented by an integral trim press of the type that can cut circular holes in plastic sheet material of any one of a number of selected diameters. The use of a trim press to create an extended flange having the properties heretofore described, provides a cup lid with a restricted diameter edge that is capable of grasping the brim of a drinking cup with the same retention force as a cup lid manufactured by a conventional thermal forming process without the need for making any inconvenient, time consuming, and expensive tooling changes or using thicker and more expensive sheet material.

BRIEF DESCRIPTION OF THE SEVERAL FIGURES

DETAILED DESCRIPTION OF THE PREFERRED EMBODIMENT

Figure 1A:
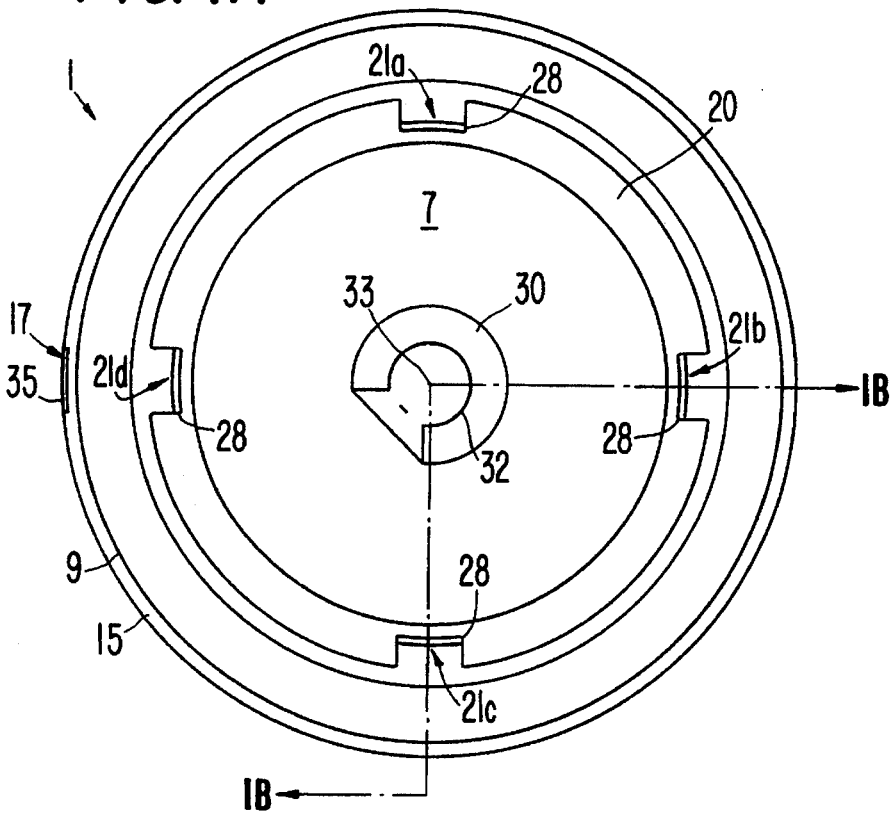
FIG. 1A is a plan view of the beverage cup of the invention.
Figure 1B:
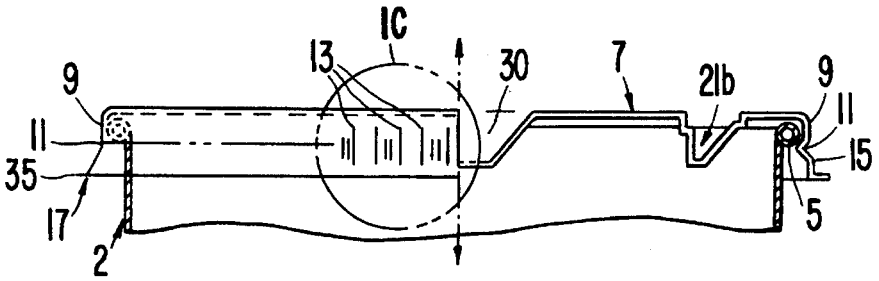
FIG. 1B is a partial cross-sectional side view of the cup lid of FIG. 1A, illustrating how the restricted diameter in the side wall of the lid snaps over the brim of the open end of a disposable beverage cup.
Figure 1C:
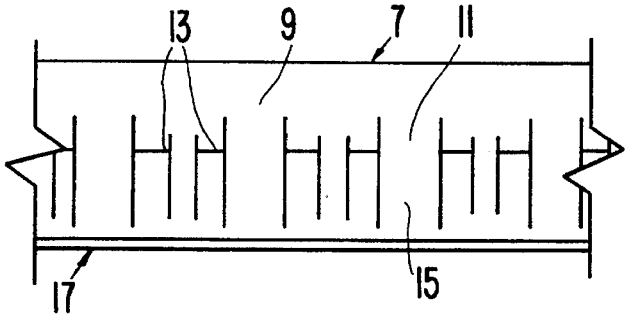
FIG. 1C is an enlargement of the portion of the lid contained within the dotted circle in FIG. 1B.

With reference now to FIGS. 1A, 1B, and 1C, the lid 1 of the invention is designed to be snap-fitted over a beverage cup 3 (shown in FIG. 1B) of the type having a brim 5 circumscribing its open end. The lid 1 generally comprises a circular closure panel 7 having a side wall or bead 9 which circumscribes its periphery. One end of the side wall 9 is integrally connected with the edge of the panel 7, while the other end terminates in a restricted diameter 11 that is designed to snap over and capture the brim 5 of a cup 3 in the manner shown in FIG. 1B. To give the restricted diameter 11 the flexibility it requires in order to resiliently snap-fit over the brim 5, a plurality of flutes 13 are integrally molded into the side wall 9, as may best be seen in FIG. 1C. While any one of a number of different types of flutes can provide the restriction diameter 11 with the resiliency it needs, the flute pattern disclosed in U.S. Pat. No. 4,877,151 assigned to the James River Corporation, is preferred, and the entire text of this patent is herein expressly incorporated into this specification by reference. A frustro-conical skirt 15 is integrally connected to the restricted diameter 11 that circumscribes the bottom edge of the restricted diameter 11. The frustro-conical skirt performs a variety of functions, including guiding, and wedgingly snap-fitting the restricted diameter 11 of the side wall 9 over a brim 5 when a user pushes the lid 1 over the open end of a cup 3. The frustro-conical skirt 15 also helps to provide hoop strength to the restricted diameter 11 of the side wall 9, thereby increasing the retention force by which the restricted diameter 11 captures and retains the brim 5 of cup 3.

Figure 2:
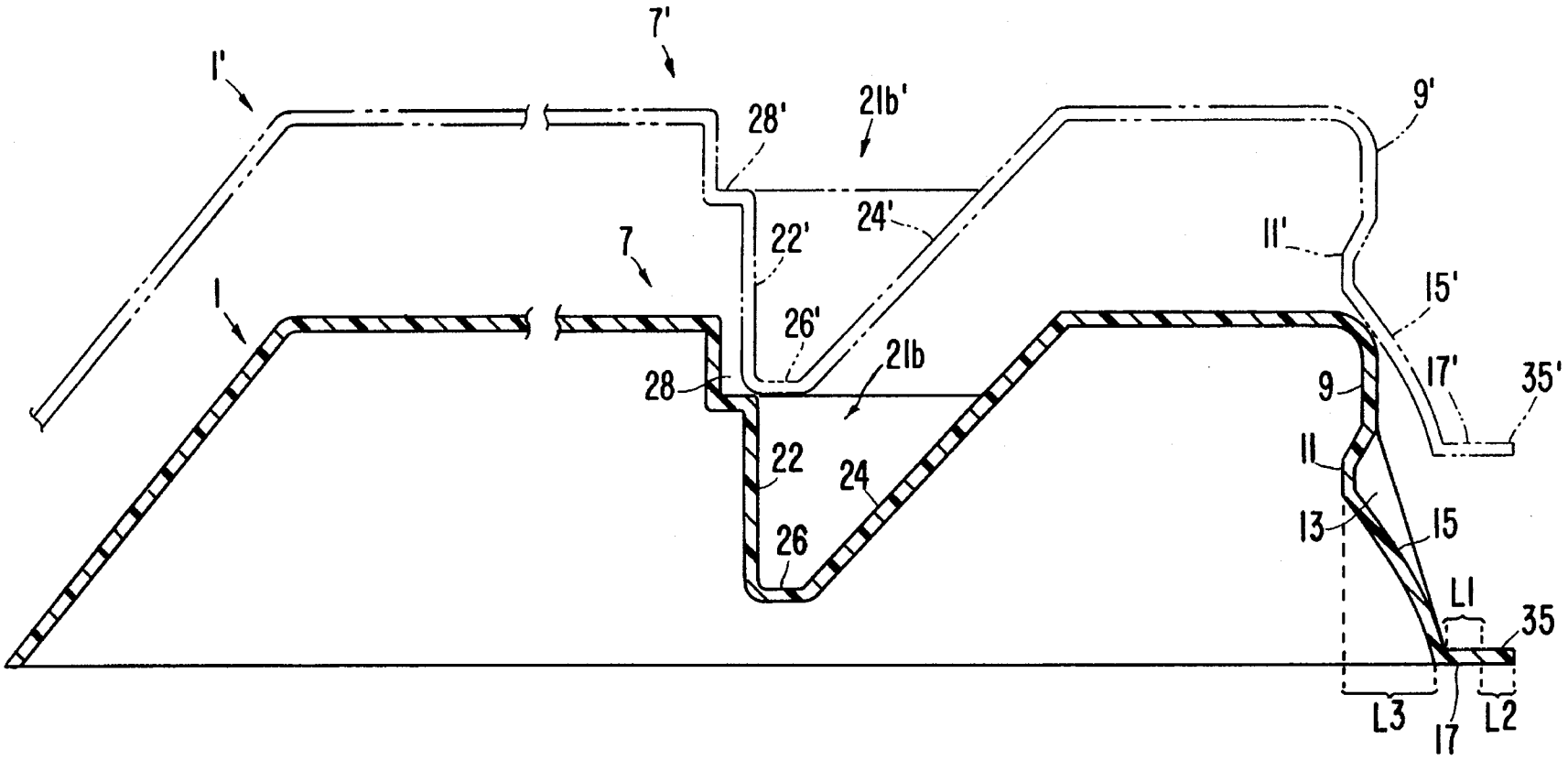
FIG. 2 is an enlarged, cross-sectional side view of the lid of the invention, illustrating the strengthening extension of the peripheral flange that serves to increase the hoop strength of the restricted diameter portion of the side wall.

With reference now to FIGS. 1A and 2, the closure panel 7 preferably includes a relatively shallow, annular recess around its mid portion as shown. Integrally formed within the annular recess 20, are four V-shaped stacking lugs 21*a–d* located at 90° intervals around the circumference of the recess. Each of these V-shaped lugs 21*a–d* includes an inner side wall 22, an outer side wall 24, and a bottom wall 26. The purpose of these V-shaped lugs 21*a–d* is to allow the lid 1 to be stacked with identical lids 1' in the manner illustrated in FIG. 2 in such a manner that the lids 1 and 1' do not stick together. It should be noted that any one of a variety of different lug designs may be employed with the present invention, as such lugs do not form part of the instant invention. Disposed at the very center of the closure panel 7 is a circular depression 30 having an arcuate straw slot 32 that defines a straw punch-out region 33. The provision of the depression 30 prevents any of the liquid contents of the cup 3 that runs out on top of the lid 1 when a straw is pushed through the punch out 33 from running over the sides of the lid 1 and getting on the clothes of the user.

With reference now to FIG. 2, the flange 17 of the lid 1 includes an integrally formed, annular strengthening extension 35 as shown that is dimensioned to increase the retention force of the restricted diameter 11 of the side wall 9 to an average value of at least 1.25 pounds, and more preferably 1.45 pounds. In a cup lid that does not embody the present invention, if the outer diameter of the brim 5 of the cup 3 is between 3.499 and 3.502 inches, and the inner diameter of the restricted diameter 11 is between 3.426 and 3.430, and the cap 1 is formed from high impact polystyrene plastic sheet material having a thickness of 9 mils in the molds of a plastic web machine manufactured by James River of Norwalk, Conn., the radial extent L1 of the peripheral flange 17 would be 0.030 inches. The restricted diameter of such non-inventive lids have an average retention force of only about 1.08 pounds around the brim 5 of a cup 3. By contrast, when a strengthening extension 35 is integrally formed with the flange 17 that has a radial length L2 of 0.043 inches, the total radial extent of the flange 17 increases from 0.030 to 0.072 inches, which in turn increases the retention force of the restricted diameter 11 around the brim 5 from an average value of about 1.08 pounds to an average value of about 1.45 pounds. The radial extent L3 of the skirt 15 is on the average 0.079 inches, and another way of viewing the invention is in terms of the ratio of the total radial extent of the flange 17 with and without the flange extension 35. Specifically, the radial extent of the flange 17 by itself is only about 38% of the radial extent of the skirt 15. By contrast, the radial extent of the flange 17 in combination with the extension 35 is 91% of the radial extent of the skirt 15. The increased radial length of the resulting flange 17 has been further found to facilitate removal of the lid by a user by providing a larger grasping surface for the finger of such a user.

In the method of the invention, a lid is formed from a sheet of heat fusible, plastic sheet material of the type and dimensions as heretofore described. The plastic sheet material is fed into the previously referred to plastic web machine. Such machines include a contact heater having a smooth, contoured heating surface that overlies an arrangement of female lid molds. The plastic sheet material is fed between the surface of the contact heater, and the lid molds so that the sheet material is placed into contact with the heating surface. The contact heater then proceeds to apply a pattern of heat to the sheet material only on those portions of the material which will be deformed by the lid molds. After heat from the contact heater has selectively softened those portions to be deformed by the lid molds, a partial vacuum is drawn between the sheet material and the molds, while at the same time air pressure is applied between the contact heater and the sheet material in order to draw the sheet material tightly against the surfaces of the lid molds. The lid molds then proceed to deform the sheet material into an array of lid blanks, each having a profile as shown in FIG. 2 with the exception that the free end of the frustro-conical skirt 11 terminates in unused sheet material between adjacent lid blanks, instead of in the flange 17. In the final steps of the method of the invention, the lid blanks that are in effect embossed in the sheet material are each aligned with the circular cutter of an integral trim press, which proceeds to punch the finished lids out in much the same fashion as a paper punch. The circular cutters of the trim press are each adjusted so that the length of the flange 17 and flange extension is on the order of 0.072 inches for all the reasons heretofore described. The diameter of the holes punched by such trim presses may be adjusted by the manufacturing facility by changing the trim tools so that the radial length of the resulting flange 17 is 0.072 inches. This can be accomplished by boring the existing dies larger and manufacturing new larger punches.

We claim:

1. An improved lid detachably affixable over the brim of a beverage cup formed from a plastic sheet material and having a generally Circular closure panel circumscribed by a side wall that terminates in a resilient, restricted diameter edge for capturing a brim of a beverage cup between said edge and said side wall and retaining said lid over said cup; a frustro-conical skirt connected around said restricted diameter edge for increasing the hoop strength of said restricted diameter edge and for guiding said cup brim into said edge and wedgingly snap-fitting it around said brim, said skirt having a free edge terminating in a flange, wherein the thickness of the sheet material forming the skirt is less than the thickness of the sheet material forming the circular panel, and the radial extent of said flange is between about 30 and 46% of the radial extent of said skirt wherein the improvement comprises flange extension means circumscribing the flange of said skirt and having a radial extent of between about 40 and 60% of the radial extent of said skirt for increasing the hoop strength of the restricted diameter edge such that said edge retains said brim with a force of over 1.25 pounds, and for providing a surface that facilitates removal of the lid by the finger of a user.

2. A lid as described in claim 1, wherein said lid is formed from a single piece of resilient, fusible plastic sheet material, in a plastic web machine that causes the thickness of the sheet material forming the skirt to be less than the thickness of the plastic forming the closure panel.

3. A lid as described in claim 1, wherein the radial extent of the flange is between about 0.020 to 0.040 inches, and the radial extent of the flange extension means is between about 0.032 to 0.052 inches.

4. A lid as described in claim 1, wherein the radial extent of the flange is between about 0.025 to 0.035 inches, and the radial extent of the flange extension means is between about 0.037 to 0.047 inches.

5. A lid as described in claim 1, wherein said frustro-conical skirt has a small diameter end that is integrally connected to said restricted diameter edge, and a large diameter free end, and wherein said flange is integrally connected to said large diameter end, and said flange extension means is integrally connected to the outer periphery of said flange.

6. A lid as described in claim 1, wherein said flange extension means increases the retention force of said lid around said brim by between 0.27 and 0.47 pounds.

* * * * *